US005300760A

United States Patent [19]

Batliwalla et al.

[11] Patent Number: 5,300,760

[45] **Date of Patent: * Apr. 5, 1994**

[54] METHOD OF MAKING AN ELECTRICAL DEVICE COMPRISING A CONDUCTIVE POLYMER

[75] Inventors: Neville S. Batliwalla, Foster City; Amitkumar N. Dharia, Newark; Randall M. Feldman, Redwood City; Ashok K. Mehan, Union City, all of Calif.

[73] Assignee: Raychem Corporation, Menlo Park, Calif.

[ * ] Notice: The portion of the term of this patent subsequent to May 5, 2009 has been disclaimed.

[21] Appl. No.: 823,524

[22] Filed: Jan. 21, 1992

Related U.S. Application Data

[63] Continuation of Ser. No. 322,969, Mar. 13, 1989, Pat. No. 5,111,032.

[51] Int. Cl.[5] ..... H05B 3/34

[52] U.S. Cl. ..... 219/549; 219/528; 219/544; 219/545; 174/47; 174/107; 338/22 R

[58] Field of Search ..... 219/553, 535, 544, 549, 219/538, 528, 545; 29/611; 264/174; 156/390, 86; 338/212, 22 R; 174/47, 107

[56] References Cited

U.S. PATENT DOCUMENTS

| | | | |
|---|---|---|---|
| 3,793,716 | 2/1974 | Smith-Johannsen | 29/611 |
| 3,828,112 | 8/1974 | Johansen et al. | 174/47 |
| 3,829,545 | 8/1974 | Van Vlaenderen | 264/174 |
| 3,858,144 | 12/1974 | Bedard et al. | 338/22 R |
| 3,861,029 | 1/1975 | Smith-Johannsen et al. | 29/611 |
| 3,876,487 | 4/1975 | Garrett et al. | 156/390 |
| 4,017,715 | 4/1977 | Whitney et al. | 219/553 |
| 4,177,446 | 12/1979 | Diaz | 338/212 |
| 4,223,209 | 9/1980 | Diaz | 219/549 |
| 4,234,669 | 11/1980 | Pearlman | 430/25 |
| 4,242,573 | 12/1980 | Batliwalla | 219/528 |
| 4,246,468 | 1/1981 | Horsma | 219/553 |
| 4,255,504 | 3/1981 | Hakala | 430/28 |
| 4,318,220 | 3/1982 | Diaz | 29/611 |
| 4,327,351 | 4/1982 | Walker | 338/22 R |
| 4,334,148 | 6/1982 | Kampe | 219/553 |
| 4,334,351 | 6/1982 | Sopory | 29/611 |
| 4,398,084 | 8/1983 | Walty | 219/528 |
| 4,400,614 | 8/1983 | Sopory | 219/528 |
| 4,421,582 | 12/1983 | Horsma et al. | 156/86 |
| 4,426,339 | 1/1984 | Kamath et al. | 264/22 |
| 4,435,639 | 3/1984 | Gurevich | 219/544 |
| 4,459,473 | 7/1984 | Kamath | 219/553 |
| 4,471,215 | 9/1984 | Blumer | 219/553 |
| 4,547,659 | 10/1985 | Leary et al. | 219/544 |
| 4,574,188 | 3/1986 | Midgley et al. | 219/549 |
| 4,582,983 | 4/1986 | Midgley et al. | 219/539 |
| 4,659,913 | 4/1987 | Midgley et al. | 219/549 |
| 4,661,687 | 4/1987 | Afkhampour et al. | 219/301 |
| 4,673,801 | 6/1987 | Leary et al. | 219/544 |
| 4,700,054 | 10/1987 | Triplett et al. | 219/545 |
| 4,719,335 | 1/1988 | Batliwalla et al. | 219/528 |
| 4,764,664 | 8/1988 | Kamath et al. | 219/548 |
| 4,845,343 | 7/1989 | Aune et al. | 219/545 |
| 4,849,611 | 7/1989 | Whitney et al. | 219/538 |
| 4,919,744 | 4/1990 | Newman | 156/308.2 |
| 4,922,083 | 5/1990 | Springs et al. | 219/549 |
| 5,108,858 | 4/1992 | Patel et al. | 430/25 |
| 5,111,032 | 5/1992 | Batliwalla et al. | 219/549 |

FOREIGN PATENT DOCUMENTS

| | | |
|---|---|---|
| 0136795 | 4/1985 | European Pat. Off. . |
| 0304007 | 2/1989 | European Pat. Off. . |
| 2850722 | 5/1980 | Fed. Rep. of Germany . |
| 1175784 | 11/1958 | France . |
| 891423 | 3/1962 | United Kingdom . |

*Primary Examiner*—Bruce A. Reynolds
*Assistant Examiner*—Tu Hoang
*Attorney, Agent, or Firm*—Marquerite E. Gerstner; Herbert G. Burkard; Timothy H. P. Richardson

[57] ABSTRACT

An electrical device, particularly a self-regulating strip heater, has improved thermal efficiency, good mechanical properties, and acceptable resistance to water penetration when an outer insulating layer is applied in a way that it penetrates the interstices of a braid surrounding the heater. Appropriate penetration may be achieved by pressure-extruding the outer jacket over the braid.

18 Claims, 2 Drawing Sheets

METHOD OF MAKING AN ELECTRICAL DEVICE COMPRISING A CONDUCTIVE POLYMER

CROSS-REFERENCE TO RELATED APPLICATIONS

This application is a continuation application of copending, commonly assigned application No. 07/322,969 (Batliwalla et al), filed Mar. 13, 1989, now U.S. Pat. No. 5,111,032, the disclosure of which is incorporated herein by reference.

1. Field of the Invention

This invention relates to electrical devices comprising an insulating jacket.

2. Introduction to the Invention

Electrical devices such as electrical heaters, heat-sensing devices and other devices whose performance depends on thermal transfer characteristics are well-known. Such devices generally comprise a resistive element and an insulating jacket. Many devices comprise an auxiliary member which is separated from the resistive element by the insulating jacket. The auxiliary member is most commonly a metallic braid which is present to act as a ground, but which also provides physical reinforcement. Particularly useful devices are heaters which comprise resistive heating elements which are composed of conductive polymers (i.e. compositions which comprise an organic polymer and, dispersed or otherwise distributed therein, a particulate conductive filler), particularly PTC (positive temperature coefficient of resistance) conductive polymers, which render the heater self-regulating. Self-regulating strip heaters are commonly used as heaters for substrates such as pipes.

The effectiveness of a heater depends on its ability to transfer heat to the substrate to be heated. This is particularly important with self-regulating heaters for which the power output depends upon the temperature of the heating element. Consequently, much effort has been devoted to improving the heat transfer from heater to substrate, including the use of a heat-transfer material, e.g. a heat-transfer cement, slurry or adhesive, between the heater and the substrate, and the use of clamps or a rigid insulating layer to force the heater into contact with the pipe. However, these solutions are not free from disadvantages. Heat-transfer materials are often messy to apply and, if "cured", may restrict removal or repositioning of the heater. Clamps or other rigid materials may restrict the expansion of a PTC conductive polymer in the heater, thus limiting its ability to self-regulate.

SUMMARY OF THE INVENTION

We have now realized in accordance with the present invention, that the presence of air gaps (or other zones of low thermal conductivity) within an electrical device, particularly a self-regulating heater, has an adverse effect on the performance of the device and that by taking measures to increase the thermal conductivity of such zones, substantial improvements in efficiency can be obtained. The invention is particularly valuable for improving the efficiency of devices which comprise an auxiliary member, e.g. a metallic grounding braid, having interstices therein, since conventional manufacturing techniques result in air being trapped in such interstices. The preferred method of increasing the thermal conductivity of the zones of low thermal conductivity is to fill them with a liquid (including molten) material which thereafter solidifies in place.

In one aspect, this invention provides an electrical device which comprises (1) a resistive element;
(2) an insulating jacket;
(3) an auxiliary member which contains interstices and which is separated from the resistive element by the insulating jacket; and
(4) blocking material which fills interstices in the auxiliary member.

In a second aspect, this invention provides a flexible elongate electrical heater which comprises (1) an elongate resistive heating element;
(2) a first elongate jacket which is composed of an insulating polymeric material, and which surrounds the heating element;
(3) a metallic braid which surrounds and contacts the first insulating jacket; and
(4) a second elongate jacket which is composed of a polymeric material, which surrounds and contacts the metallic braid, and a part of which passes through apertures in the metallic braid and thus contacts the first jacket.

In a third aspect, this invention provides a method of making a device of the first aspect of the invention.

DETAILED DESCRIPTION OF THE INVENTION

Figure 1:
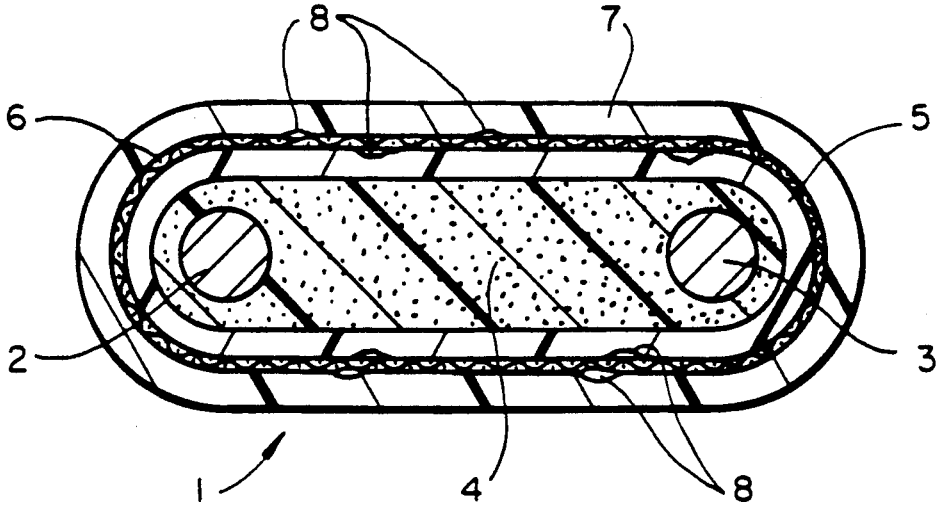
FIG 1 (PRIOR ART)
FIG. 1 shows cross-sectional view of a conventional electrical device.

Electrical devices of the invention comprise at least one resistive element, often in the form of a strip or a sheet, and an insulating jacket surrounding the resistive element. The device may be a sensor or heater or other device. When the device is a heater, it may be a series heater, e.g. a mineral insulated (MI) cable heater or nichrome resistance wire heater, a parallel heater, or another type, e.g. a SECT (skin effect current tracing) heater. Particularly suitable parallel heaters are self-regulating strip heaters in which the resistive element is an elongate heating element which comprises first and second elongate electrodes which are connected by a conductive polymer composition. The electrodes may be embedded in a continuous strip of the conductive polymer, or one or more strips of the conductive polymer can be wrapped around two or more electrodes. Heaters of this type, as well as laminar heaters comprising conductive polymers, are well known; see, for example, U.S. Pat. Nos. 3,858,144 (Bedard et al), 3,861,029 (Smith-Johannsen et al), 4,017,715 (Whitney et al), 4,242,573 (Batliwalla), 4,246,468 (Horsma), 4,334,148 (Kampe), 4,334,351 (Sopory), 4,398,084 (Walty), 4,400,614 (Sopory), 4,425,497 (Leary), 4,426,339 (Kamath et al), 4,435,639 (Gurevich), 4,459,473 (Kamath) 4,547,659 (Leary), 4,582,983 (Midgley et al), 4,574,188 (Midgley et al), 4,659,913 (Midgley et al), 4,661,687 (Afkhampour et al), 4,673,801 (Leary), 4,700,054 (Triplett et al), and 4,764,664 (Kamath et al). Other suitable heaters and devices are disclosed in copending commonly assigned patent application No. 810,134 (Whitney et al, filed Dec. 16, 1985, now U.S.

Pat. No. 4,849,611. The disclosure of each of the above patents and applications is incorporated herein by reference.

In order to provide electrical insulation and environmental protection, the resistive element is surrounded by an electrically insulating jacket which is often polymeric, but may be any suitable material. This insulating jacket may be applied to the resistive element by any suitable means, e.g. by extrusion, either tube-down or pressure, or solution coating. In this application a "tube-down extrusion" is defined as a process in which a polymer is extruded from a die in a diameter larger than that desired in the final product and is drawn-down, by virtue of a vacuum or rapid pulling of the extrudate from the die, onto a substrate. A "pressure extrusion" is defined as a process in which polymer is extruded from a die under sufficient pressure to maintain a specified geometry. Such an extrusion technique is also known as "profile extrusion". With either type of extrusion technique, there may be air gaps between the resistive element and the insulating jacket.

For mechanical strength, it is often preferred that the insulating jacket be surrounded by an auxiliary member which may be reinforcing. This auxiliary member may be of any suitable design, e.g. a braid, a sheath, or a fabric, although braids or other perforated layers are preferred for flexibility. The auxiliary member may comprise any suitably strong material, e.g. polymeric or glass fibers or metal strands, although metal strands woven into a braid are preferred in order that the heater may be electrically grounded as well as reinforced. The size of the interstices is a function of the tightness of weave of the braid. If the auxiliary member is perforated, the perforations may be of any convenient size and shape. In order that the blocking material adequately penetrates the interstices, it is preferred that the interstices (the term "interstices" being used to include not only apertures or perforations which pass completely through the auxiliary member, but also depressions or openings in the surface of the auxiliary member) comprise at least 5%, preferably at least 10%, particularly at least 15%, e.g. 20 to 30%, of the external surface area of the auxiliary member. As a result of the interstices of the braid or the perforations in the sheath, air gaps are present. Additional air gaps may be created if the auxiliary member is not tightly adhered to the insulating jacket.

Some of these air gaps are eliminated and the efficiency of the heater to transfer heat to a substrate is improved by surrounding the auxiliary member with a layer of blocking material which fills at least some of the interstices of the auxiliary member. The blocking material may be either electrically conductive or electrically insulating (electrically insulating being defined as a resistivity of at least $1\times10^9$ ohm-cm). The material is preferably polymeric and serves to insulate the auxiliary member which is often a metallic grounding braid. It may be applied by any suitable method. If the material is a liquid, it may be painted, brushed, sprayed or otherwise applied to the auxiliary member so that, after curing or solidification, the material penetrates some of the interstices. If the material is a polymer, the preferred method of application is a pressure extrusion of the molten polymer over the auxiliary member. Unlike a tube-down extrusion process in which the polymer is drawn down into contact with the auxiliary member, during the pressure extrusion process the polymer both contacts the auxiliary member and is forced into the interstices. The necessary pressure required for penetration is a function of the viscosity of the polymer, the size of the interstices, and the depth of penetration required. For some applications, it is preferred that the blocking material completely penetrate the braid, allowing contact between, and in some cases bonding of, the blocking material to the insulating jacket. In other cases there is contact between the blocking material and the insulating jacket, but no bonding of the blocking material to the insulating jacket.

Although any level of penetration of the interstices is preferable to none, the thermal efficiency of most strip heaters is improved when at least 20%, preferably at least 30%, particularly at least 40% of the interstices of the auxiliary member are filled with the blocking material. In this context, it is the surface interstices, i.e. those present at the interface between the auxiliary member and the blocking material, not the interstices present in the interior of the auxiliary member (particularly inside a braid), which are considered when the extent of filled interstices is determined. The most effective thermal transfer is achieved when the auxiliary member is completely filled and encased by the blocking polymer.

It is preferred that the blocking material be a polymer. Any type of polymer may be used, although it is preferred that the polymer have adequate flexibility, toughness, and heat-stability for normal use as part of a heater or other electrical device and appropriate viscosity and melt-flow properties for easy application. Suitable polymers include polyolefins, e.g. polyethylene and copolymers such as ethylene/ethyl acrylate or ethylene/acrylic acid, fluoropolymers, e.g. fluorinated ethylene/propylene copolymer or ethylene/tetrafluoroethylene copolymer, silicones, or thermoplastic elastomers. When it is preferred that the blocking material be bonded to the insulating jacket, either the blocking material or the insulating jacket may comprise a polymer containing polar groups (e.g. a grafted copolymer) which contribute to its adhesive nature. The insulating material may comprise additives, e.g. heat-stabilizers, pigments, antioxidants, or flame-retardants. When it is preferred that the blocking material itself have good thermal conductivity, the additives may include particulate fillers with high thermal conductivity. Suitable thermally conductive fillers include zinc oxide, aluminum oxide, other metal oxides, carbon black and graphite. If the thermally conductive particulate filler is also electrically conductive and it is necessary that the blocking material be electrically insulating, it is important that the conductive particulate filler be present at a low enough level so that the insulating material remains electrically insulating.

A particularly preferred device of the invention is a flexible elongate electrical heater, e.g. a strip heater, in which the resistive heating element, preferably comprising a conductive polymer composition, is surrounded by a first insulating polymeric jacket, and then by a metallic braid. A second polymeric jacket surrounds and contacts the braid. At least some of the polymer of the second jacket penetrates the braid; it may contact, and even bond to, the polymer of the first jacket.

A particularly suitable use for electrical devices of the invention is as heaters which are in direct contact with, e.g. by immersion or embedment, substrates which require excellent thermal transfer. Such substrates may be liquid, e.g. water or oil, or solid, e.g. concrete or metal. Devices of this type may be used to melt ice and snow, e.g. from roofs and gutters or on sidewalks.

The improvement in performance of electrical devices of the invention over conventional devices can be determined in a variety of ways. When the electrical devices are heaters it is useful to determine the active power $P_a$ and the passive power $P_p$ at a given voltage using the formulas VI and $V^2/R$, respectively. (V is the applied voltage, I is the measured current at that voltage, and R is the resistance of the heater to be tested). The thermal efficiency TE can be determined by $[(P_a/P_p) * 100\%]$. For a heater with perfect thermal efficiency, the value Qf TE would be 100. When tested under the same environmental and electrical conditions, devices of the invention preferably have a thermal efficiency which is at least 1.01 times, particularly at least 1.05 times, especially 1.10 times the thermal efficiency of a conventional device without the blocking material. The TE value normally is higher when the environment surrounding the device, e.g. the substrate, has a high thermal conductivity. The most accurate comparisons of thermal efficiency can be made for devices which have the same geometry, resistance, core polymer, and resistance vs. temperature response. A second measure of the improvement provided by the invention is the thermal resistance TR. This quantity is defined as $[(T_c-T_e)/P_a]$, where $T_c$ is the core temperature of the device and $T_e$ is the environmental (i.e. ambient) temperature. The value of $T_c$ is not directly measured but is calculated by determining the resistance at the active power level and then determining what the temperature is at that resistance. This temperature can be estimated from an R(T) curve, i.e. a curve of resistance as a function of temperature which is prepared by measuring the resistance of the device at various temperatures. The value of TR is smaller for devices with more effective thermal transfer. It is only useful in a practical sense when the value is greater than 2° F./watt/ft; smaller values can arise due to an inaccurate estimation of $T_c$ from an R(T) curve.

Figure 2:
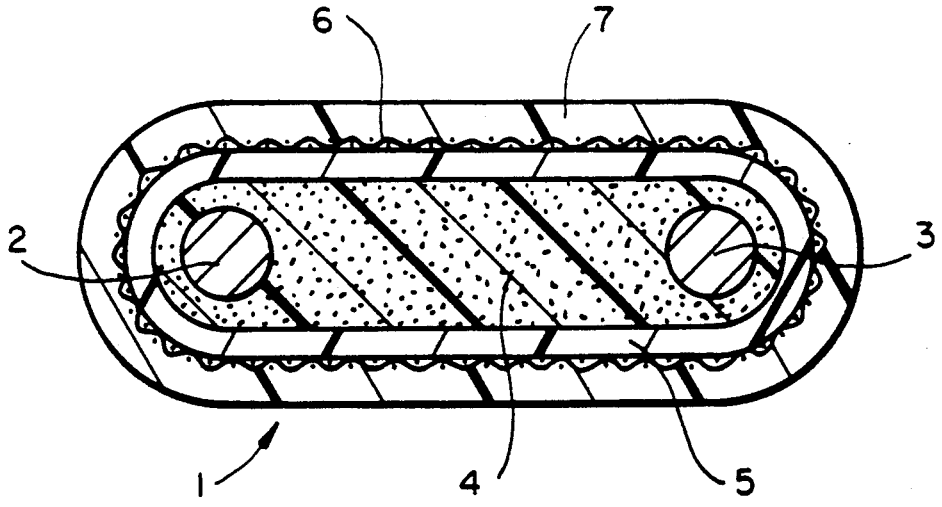
FIG. 2 shows a cross-sectional view of an electrical device of the invention.
Figure 3:
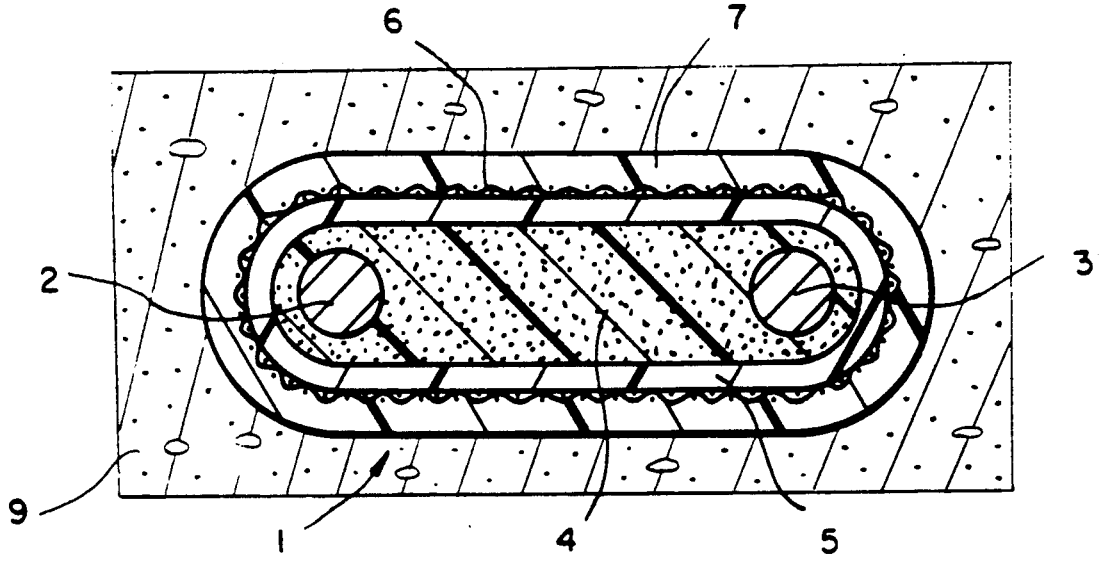
FIG. 3 shows a cross-sectional view of an electrical device of the invention which is embedded in concrete.

Referring to the drawing, both FIG. 1 and FIG. 2 are cross-sectional views of an electrical device 1 which is a self-regulating strip heater. FIG. 1 illustrates a conventional heater; FIG. 2 is a heater of the invention. In both figures first and second elongate wire electrodes 2,3 are embedded in a conductive polymer composition 4. This core is surrounded sequentially by a first insulating jacket 5, a metallic grounding braid 6, and an outer insulating layer 7. In FIG. 1 small air gaps and voids 8 are evident between the braid 6 and the outer insulating layer 7, and between the braid 6 and the first insulating jacket 5. In FIG. 2 there is penetration of the outer insulating layer 7 into the braid 6. FIG. 3 shows in cross-section the strip heater 1 of FIG. 2 embedded in a mass of concrete 9, e.g. a sidewalk.

The invention is illustrated by the following examples in which Example 1 is a comparative example.

EXAMPLE 1

A conductive polymer composition comprising polyvinylidene fluoride and carbon black was melt-extruded over two 14 AWG stranded nickel-coated copper wires to produce a heater "core" with a generally rectangular cross-section. Using thermoplastic elastomer (TPE), a first insulating jacket of 0.030 inch (0.076 cm) was extruded over the core using a "tube-down" extrusion technique. The heater was then irradiated to 2.5 Mrad. A metal braid comprising five strands of 28 AWG tin-coated copper wire was formed over the inner insulating jacket to cover 86 to 92% of the surface. The braid had a thickness of about 0.030 inch (0.076 cm). Using a tube-down extrusion technique, an outer insulating layer of 0.070 inch (0.178 cm) thickness was extruded over the braid using TPE. The resulting heater had a width of approximately 0.72 inch (1.83 cm) and a thickness of 0.38 inch (0.97 cm). There was essentially no penetration of the outer TPE layer into the braid and small air gaps were visible between the first insulating jacket and the outer jacket in the braid interstices.

Samples of the heater were tested and the results are shown in Table I. The resistance of a one foot (30.48 cm) long heater was measured at 70° F. (21° C.). The PTC characteristics were determined by placing a heater sample in an oven, measuring the resistance at various temperatures, and plotting resistance as a function of temperature (i.e. generating an R(T) curve). Reported in Table I are the temperatures at which the resistance had increased by 10 times and 50 times from its initial value at 70° F. (21° C.).

The thermal and electrical properties of one-foot long samples of the heater were measured under three conditions: (A) in a convection oven in air at 14° F. (−10° C.), (B) clamped to a steel pipe with a 2-inch outer diameter and covered with 1 inch of fiberglas insulation, and (C) immersed in glycol after sealing the exposed end. Prior to testing, the samples were conditioned in a two step process: (1) 4 hours unpowered at 14° F. (−10° C.) followed by (2) 18 hours at 14° F. while powered at 240 VAC. The resistance was measured at the end of the first step at 14° F. (−10° C.) and designated $R_i$. Under each condition, the current I was measured for the heater sample when powered at three voltages V: 110, 220, and 260 VAC. Passive power, $P_p$, and active power, $P_a$, were calculated from $(V^2/R_i)$ and (VI), respectively. Thermocouples were present in the oven, attached to the pipe, and in the glycol in order to determine the environmental temperature $T_e$. For all three test conditions, $T_e$ was determined to be 14° F. (−10° C.). The thermal resistance $T_R$ and the thermal efficiency TE of the heater were determined as previously described.

The resistance of the heater to water penetration was measured by inserting the end of a 5-foot long heater into a water inlet tube through a water-tight seal. Water was forced through the sealed end of the heater at a constant pressure and the volume of water present at the unsealed heater end after one minute was collected. This volume represented the water migration down the heater through the air gaps and voids in the braid and between the braid and the inner and outer jackets. In a separate experiment, the volume of water penetrating the braid during a 16 hour period without any applied pressure was also measured.

EXAMPLE 2

A heater was extruded, jacketed with a first insulating jacket, irradiated and braided as in Example 1. Using a pressure-extrusion technique and a head-pressure at the die of approximately 2000 psi, an outer insulation layer of TPE was extruded over the braid. The resulting heater had a width of approximately 0.74 inch (1.88 cm) and a thickness of 0.35 inch (0.89 cm). Some of the TPE was forced through the interstices of the braid, resulting in a total braid and outer layer thickness of 0.070 inch (0.178 cm), i.e. equivalent to the outer jacket thickness alone in Example 1. No air voids were visible between the braid and the outer jacket.

The results of testing the heater under a variety of conditions are shown in Table I. Both the heater with the tube-down outer layer (Example 1) and that with the pressure-extruded outer layer (Example 2) had comparable resistance values at 70° F. and comparable PTC characteristics. The heater of Example 2 had lower thermal resistance and higher thermal efficiency, particularly under good heat-sinking conditions (e.g. in glycol), as well as improved water blocking properties.

TABLE 1

| | Example 1 | | | Example 2 | | |
|---|---|---|---|---|---|---|
| Jacketing procedure over braid | Tube-down | | | Pressure | | |
| Resistance @ 70° F. (ohm/ft) | 961 | | | 1020 | | |
| Resistance increase (T in °F./°C.): | | | | | | |
| 10X | 195/91 | | | 194/90 | | |
| 50X | 225/107 | | | 224/107 | | |
| Thermal properties: | | | | | | |
| Voltage (VAC) | 110 | 220 | 260 | 110 | 220 | 260 |
| (A) Air oven @ 14° F. (−10° C.) | | | | | | |
| $R_i$ (ohms/ft @ 14° F.) | 832 | 832 | 832 | 828 | 828 | 828 |
| $P_p$ (watts/ft) | 14.5 | 58.2 | 81.3 | 14.6 | 58.4 | 81.6 |
| $P_a$ (watts/ft) | 12.0 | 18.9 | 20.1 | 12.1 | 20.2 | 21.6 |
| $T_c$ (°F.) | 47 | 194 | 207 | 73 | 192 | 206 |
| TR (°F./watt/ft) | — | 9.5 | 9.6 | — | 8.8 | 8.9 |
| TE (%) | 82 | 32 | 24 | 83 | 35 | 26 |
| (B) Pipe @ 14° F. (−10° C.) | | | | | | |
| $R_i$ (ohms/ft @ 14° F.) | 873 | 873 | 873 | 882 | 882 | 882 |
| $P_p$ (watts/ft) | 13.9 | 55.4 | 77.3 | 13.7 | 54.9 | 76.6 |
| $P_a$ (watts/ft) | 9.4 | 18.5 | 20.1 | 10.0 | 20.5 | 22.3 |
| $T_c$ (°F.) | 130 | 196 | 207 | 125 | 191 | 204 |
| TR (°F./watt/ft) | 12.3 | 9.8 | 9.6 | 8.1 | 8.6 | 8.5 |
| TE (%) | 66 | 33 | 26 | 73 | 37 | 29 |
| (C) Glycol @ 14° F. (−10° C.) | | | | | | |
| $R_i$ (ohms/ft @ 14° F.) | 906 | 906 | 906 | 900 | 900 | 900 |
| $P_p$ (watts/ft) | 13.4 | 53.4 | 74.6 | 13.5 | 54.0 | 75.5 |
| $P_a$ (watts/ft) | 12.4 | 26.0 | 27.8 | 13.5 | 37.0 | 41.4 |
| $T_c$ (°F.) | 1 | 174 | 190 | 1 | 137 | 163 |
| TR (°F./watt/ft) | * | 6.1 | 6.3 | * | 3.3 | 3.6 |
| TE (%) | 92 | 49 | 37 | 100 | 68 | 55 |
| Water blocking (ml/1 minute): | | | | | | |
| 0 psi pressure | 41 | | | 0.005 | | |
| 5 | 70 | | | 1.5 | | |
| 10 | 165 | | | 5 | | |
| 15 | 250 | | | 10 | | |
| 25 | 410 | | | 20 | | |

* The value of TR was calculated to be less than 2° F./watt/ft.

What is claimed is:

1. An electrical device which comprises (1) a resistive element which comprises first and second elongate wire electrodes which are embedded in a continuous strip of conductive polymer;

(2) an insulating jacket;

(3) an auxiliary member which contains interstices and which is separated from the resistive element by the insulating jacket; and (4) blocking material which (i) fills interstices in the auxiliary member and (ii) contacts the insulating jacket but is not bonded to the insulating jacket, wherein at least one of the following conditions is present (a) the blocking material has been applied by a pressure extrusion, (b) the blocking material has been applied in the form of a liquid, and (c) the device has a thermal efficiency which is at least 1.05 times that of an identical heater which does not comprise the blocking material.

2. A device according to claim 1 wherein the blocking material comprises a polymeric compound.

3. A device according to claim 1 wherein the blocking material is electrically insulating.

4. A device according to claim 1 wherein the blocking material is electrically conductive.

5. A device according to claim 1 wherein the auxiliary member is a braid.

6. A device according to claim 5 wherein the braid is a metallic grounding braid.

7. A device according to claim 1 wherein the blocking material fills at least 20% of the interstices of the auxiliary member.

8. A device according to claim 7 wherein the blocking material fills at least 30% of the interstices of the auxiliary member.

9. A device according to claim 1 wherein the blocking material comprises the same material as the insulating jacket.

10. A device according to claim 1 wherein the blocking material comprises a thermally conductive particulate filler selected from the group consisting of ZnO, $Al_2O_3$, graphite and carbon black.

11. A device according to claim 1 wherein the interstices of the auxiliary member comprise at least 30% of the surface area of the auxiliary member.

12. A device according to claim 1 which is surrounded by concrete.

13. A device according to claim 1 wherein the blocking material completely fills the interstices in the auxiliary member.

14. A flexible elongate electrical heater which comprises (1) an elongate resistive heating element which comprises first and second elongate wire electrodes which are embedded in a continuous strip of conductive polymer;

(2) a first elongate jacket which is composed of an insulating polymeric material, and which surrounds the heating element;

(3) a metallic braid which surrounds and contacts the first insulating jacket; and (4) a second elongate jacket which is composed of a polymeric material, which surrounds and contacts the metallic braid, and a part of which passes through apertures in the metallic braid to fill at least 20% of the apertures and to contact but not bond to the first jacket.

15. A method making an electrical device which comprises (A) providing a device which comprises (1) a resistive element which comprises first and second elongate wire electrodes which are embedded in a continuous strip of conductive polymer, (2) an insulating jacket, and (3) an auxiliary member which contains interstices and which is separated from the resistive element by the insulating jacket; and (B) filling interstices in the auxiliary member with a blocking material which (i) passes through the interstices and (ii) contacts the insulating jacket but does not bond to the insulating jacket.

16. A method according to claim 15 wherein the blocking material comprises a polymeric compound.

17. A method according to claim 15 wherein the interstices are filled by extruding the blocking material over the auxiliary member.

18. A method according to claim 15 wherein the blocking material is in the form of a liquid.

* * * * *

UNITED STATES PATENT AND TRADEMARK OFFICE

CERTIFICATE OF CORRECTION

PATENT NO. : 5,300,760

DATED : April 5, 1994

INVENTOR(S) : Batliwalla et al

It is certified that error appears in the above-indentified patent and that said Letters Patent is hereby corrected as shown below:

Title page, Cited References [56], U.S. Patent Documents, lines 10, 13, and 38, delete the following lines

| | | | |
|---|---|---|---|
| "4,234,669 | 11/1980 | Pearlman | 430/25", |
| "4,255,504 | 3/1981 | Hakala | 430/28", and |
| "5,108,858 | 4/1992 | Patel et al. | 430/25". |

Title page, Attorney, Agent or Firm, line 1, replace "Marquerite" by --Marguerite--.

Column 2, line 29, after "shows" insert --a--.

Column 9, line 16, claim 15, after "method" insert --of--.

Signed and Sealed this

Fourth Day of October, 1994

*Attest:*

*Attesting Officer*

BRUCE LEHMAN

*Commissioner of Patents and Trademarks*